US007134567B2

(12) United States Patent
Luburic

(10) Patent No.: US 7,134,567 B2
(45) Date of Patent: Nov. 14, 2006

(54) PULL TAB ON TEAR STRIP ON PLASTIC COVER PLASTIC COVER, INCLUDING BREAK TAB FEATURE, AND RELATED APPARATUS AND METHODS

(75) Inventor: Frano Luburic, Anaheim Hills, CA (US)

(73) Assignee: Ropak Corporation, Fountain Valley, CA (US)

( * ) Notice: Subject to any disclaimer, the term of this patent is extended or adjusted under 35 U.S.C. 154(b) by 44 days.

(21) Appl. No.: 10/404,899

(22) Filed: Mar. 31, 2003

(65) Prior Publication Data

US 2003/0189048 A1 Oct. 9, 2003

Related U.S. Application Data

(63) Continuation-in-part of application No. 09/834,527, filed on Apr. 12, 2001, now abandoned.

(51) Int. Cl.
*B65D 17/40* (2006.01)

(52) U.S. Cl. ..... 220/276; 215/253

(58) Field of Classification Search ..... 220/270, 220/276, 274, 275; 215/253, 254, 256
See application file for complete search history.

(56) References Cited

U.S. PATENT DOCUMENTS

| | | | | |
|---|---|---|---|---|
| 2,950,834 | A * | 8/1960 | Mazza | 215/254 |
| 3,901,404 | A * | 8/1975 | Feldman | 215/256 |
| 3,902,621 | A * | 9/1975 | Hidding | 215/252 |
| 4,322,010 | A * | 3/1982 | Curry | 215/256 |
| 4,625,876 | A * | 12/1986 | Bullock, III | 220/276 |
| 4,718,571 | A | 1/1988 | Bordner | |
| 4,798,301 | A | 1/1989 | Bullock | |
| 4,865,216 | A * | 9/1989 | Landis | 220/270 |
| 5,617,968 | A | 4/1997 | Luburic | |
| 5,626,251 | A * | 5/1997 | Luburic et al. | 220/276 |
| 5,642,825 | A * | 7/1997 | Wohlgemuth | 215/256 |
| 6,196,408 | B1 | 3/2001 | Setty et al. | |
| 6,283,318 | B1 * | 9/2001 | Lee | 215/254 |

FOREIGN PATENT DOCUMENTS

| | | |
|---|---|---|
| CH | 672473 | 11/1989 |
| EP | 52172 | * 5/1982 |

* cited by examiner

*Primary Examiner*—Lien M. Ngo
(74) *Attorney, Agent, or Firm*—J. Mark Holland & Assoc.

(57) ABSTRACT

Apparatus and related methods for a container lid include a pull structure affixed to at least one end of a tamper evident tearstrip and positioned in an outer flange of the lid, the pull structure having a portion shaped to receive and engage a manipulator such as at least one finger of a user's hand, to assist the user to initiate tearing of the tearstrip from the lid. The shaped portion of the pull structure is configured to eliminate the need to grip the tearstrip between opposing digits of the user's hand. The lid may further include an extendible connection member positioned on at least one end of the tearstrip in an area or space generally defined as a "well." Among other things, the extendible connection member can provide additional flex to a hinge portion of the lid, without destroying the subsequent tamper-evidencing value of the lid. A satellite ring may be attached to or provided on the lid or container to provide further tamper evidencing and protection to the lid assembly.

37 Claims, 8 Drawing Sheets

PULL TAB ON TEAR STRIP ON PLASTIC COVER PLASTIC COVER, INCLUDING BREAK TAB FEATURE, AND RELATED APPARATUS AND METHODS

This application is a continuation-in-part of U.S. patent application Ser. No. 09/834,527, filed on Apr. 12, 2001, now abandoned. Priority to the aforementioned application is hereby expressly claimed in accordance with 35 U.S.C. §120 and any other applicable statutes. The contents of the aforementioned application, and of each U.S. Patent and other reference, if any, cited in that and/or in this application, are hereby incorporated herein by reference.

FIELD OF INVENTION

This invention relates to apparatus and methods regarding tamper evidencing and removal of a tearstrip from a container lid assembly, container lids having tearstrips, and more particularly to providing an improved pull tab and a connection member on such a tear strip.

BACKGROUND OF INVENTION

Tearstrips are commonly provided to enable relatively easy removal of lids from their associated containers. They can also provide some indication of tamper evidence with respect to the sealed container (e.g., has the sealed container been opened previously). Such tearstrips have been provided within injection molded lids, among others.

Within injection molded lids, however, it can remain relatively difficult for a user to grasp the end of the tearstrip to initiate removal of the tearstrip. Simple tabs formed at the end of the tearstrip remain relatively unsatisfactory in that regard, at least in comparison to the present invention. Other approaches do not provide a reusable lid to cover the container opening once the tearstrip is removed, require more complicated molding, may be less susceptible to ready stacking and nesting (especially with other existing containers and lids), and have other shortcomings.

OBJECTS AND ADVANTAGES OF THE INVENTION

Accordingly, it is an object of this invention to provide an improved lid and tearstrip combination.

It is another object of this invention to provide a tearstrip assembly in combination with a lid, including a pull ring molded at one end of the tearstrip. The lid is characterized by a downwardly-depending skirt integrally molded at its periphery, with the pull ring initially positioned within the skirt.

A further object of this invention is the provision of a container lid having a tamper-indicating tearstrip, the tearstrip being injection molded as an integral part of the lid prior to removal of the tearstrip from the remainder of the lid. The tearstrip includes at least one pull structure affixed to at least one end and positioned in an outer flange of the lid, and has a portion shaped to to assist the user to initiate tearing of the tearstrip from the lid. Depending on the application and the size of the lid, that shaped portion can be configured to receive at least one finger of a user's hand or receive some other manipulator or otherwise be manipulated. Removal of the tearstrip permits opening of the lid from its associated container, and the shaped portion on the tearstrip is configured to eliminate the need to grip the tearstrip between opposing digits on the user's hand in order to initiate the tearing.

An additional object of this invention is the provision of a tearstrip having a portion shaped to at least partially wrap around a manipulator and provide selective engagement with the manipulator to assist in tearing of the tearstrip from a lid.

Yet another object of this invention is the provision of a tearstrip positioned within a lid such that removing the entire tearstrip permits the container to be opened but also leaves a remaining portion of the lid that is capable of covering the corresponding opening in the associated container.

An additional object of this invention is the provision of a method of closing and opening a container, using a lid having the aforementioned characteristics.

Another object of this invention is to provide apparatus and methods of use of a tear-strip and lid combination of the aforementioned character, that better facilitate necessary or desirable "flex" during the molding and/or assembly process, while still maintaining sufficient/desired alignment of the pull ring within the associated lid flange. Such apparatus preferably includes a connection structure between the pull ring and one or more adjacent portions of the flange that permits some degree of "expansion" of the diameter of the lid at that location (such as may be necessary during assembly of the lid onto an associated container) while providing sufficient material memory or stiffness to urge the pull ring back into a desired generally coplanar relationship with that flange following such assembly.

A further object of this invention is to provide a container lid assembly of the aforementioned character that includes a peripherally extending structure such as a satellite ring and/or a bumper that protects against inadvertent dislodgment of the lid such as during shipment, handling, etc. of the container lid assembly, and protects against and/or helps provide evidence of tampering to the lid assembly.

Other objects and advantages of the invention will be apparent from the following specification and the accompanying drawings, which are for the purpose of illustration only.

BRIEF DESCRIPTION OF THE DRAWINGS

FIG. 1A is a copy of FIG. 10 of my U.S. Pat. No. 5,617,968).

DETAILED DESCRIPTION

Figure 1:
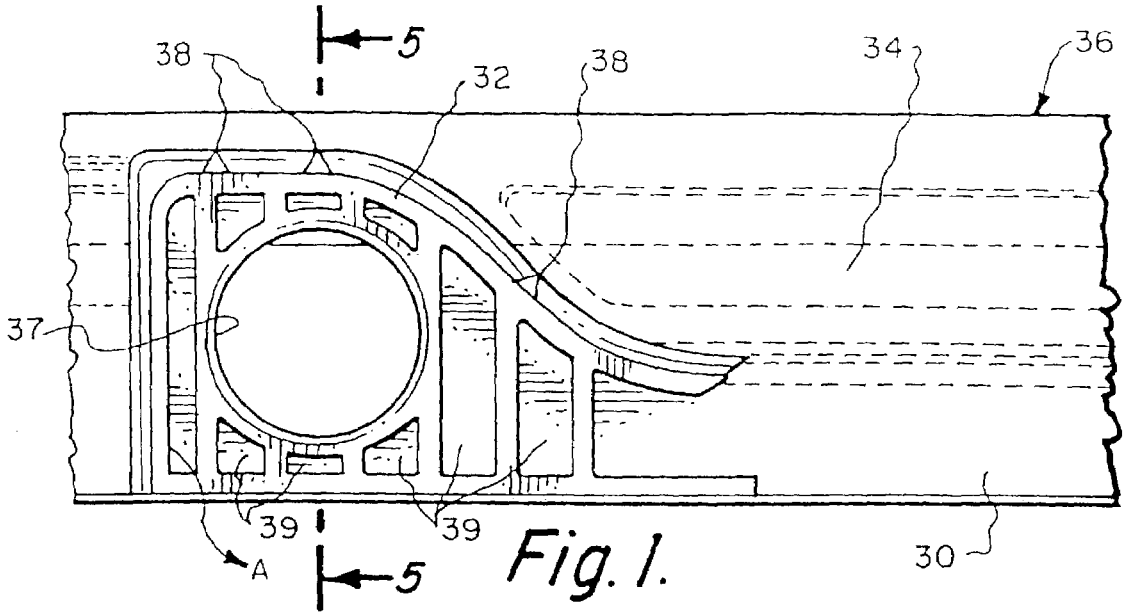
FIG. 1 is an elevation view of a preferred embodiment of the tearstrip features of the invention, illustrating a circular finger or manipulator opening for the pull structure at an end of the tearstrip.
Figure 2:
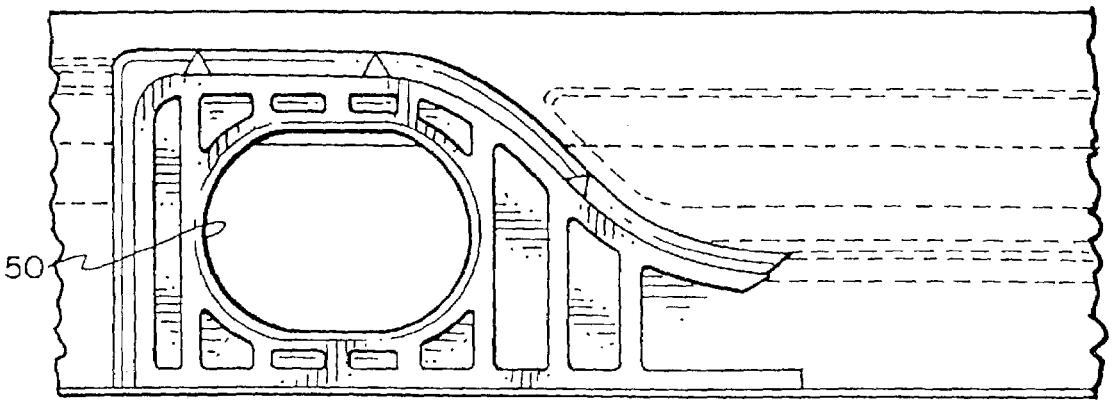
FIG. 2 is similar to FIG. 1, but illustrates one of the many alternative embodiments of the invention, an oval finger or manipulator opening.
Figure 3:
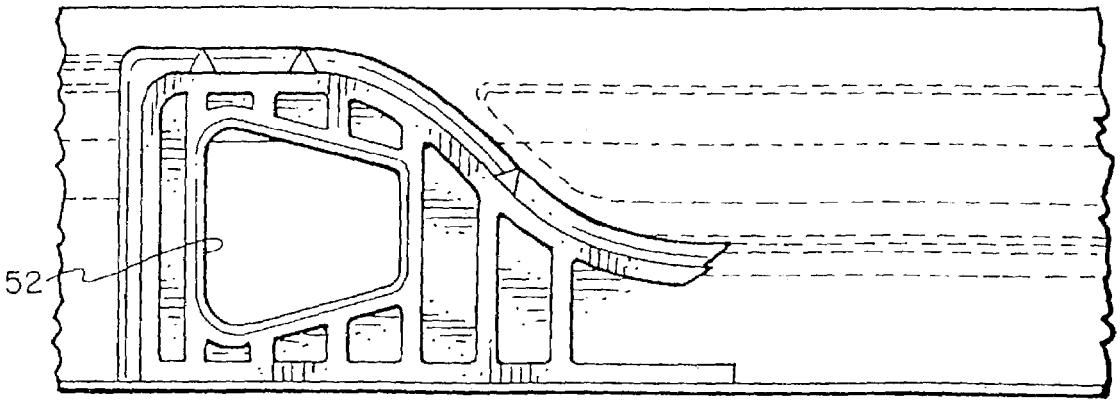
FIG. 3 is similar to FIGS. 1 and 2, but illustrates another of the many alternative embodiments of the invention, a trapezoidal finger or manipulator opening.
Figure 4:
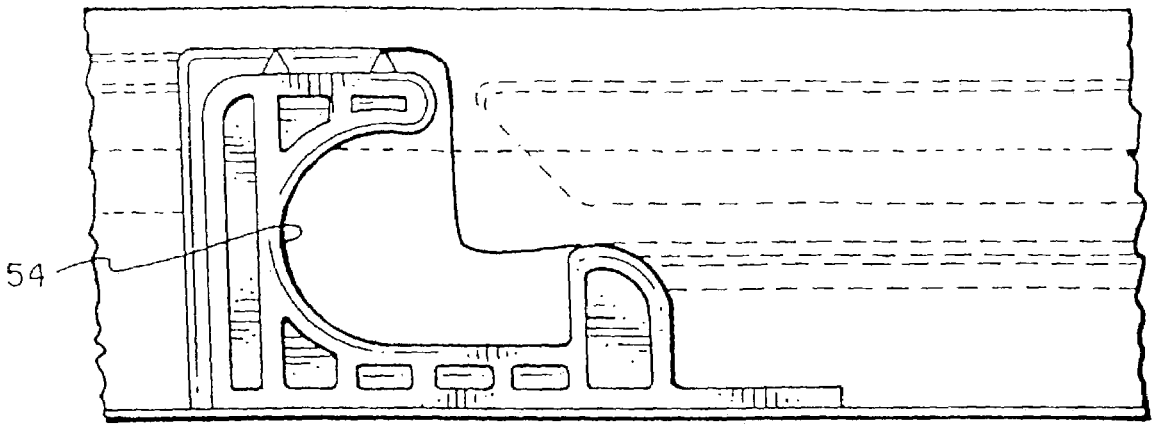
FIG. 4 is similar to FIGS. 1–3, but illustrates yet another of the many alternative embodiments of the invention, a generally C-shaped finger or manipulator opening.
Figure 5:
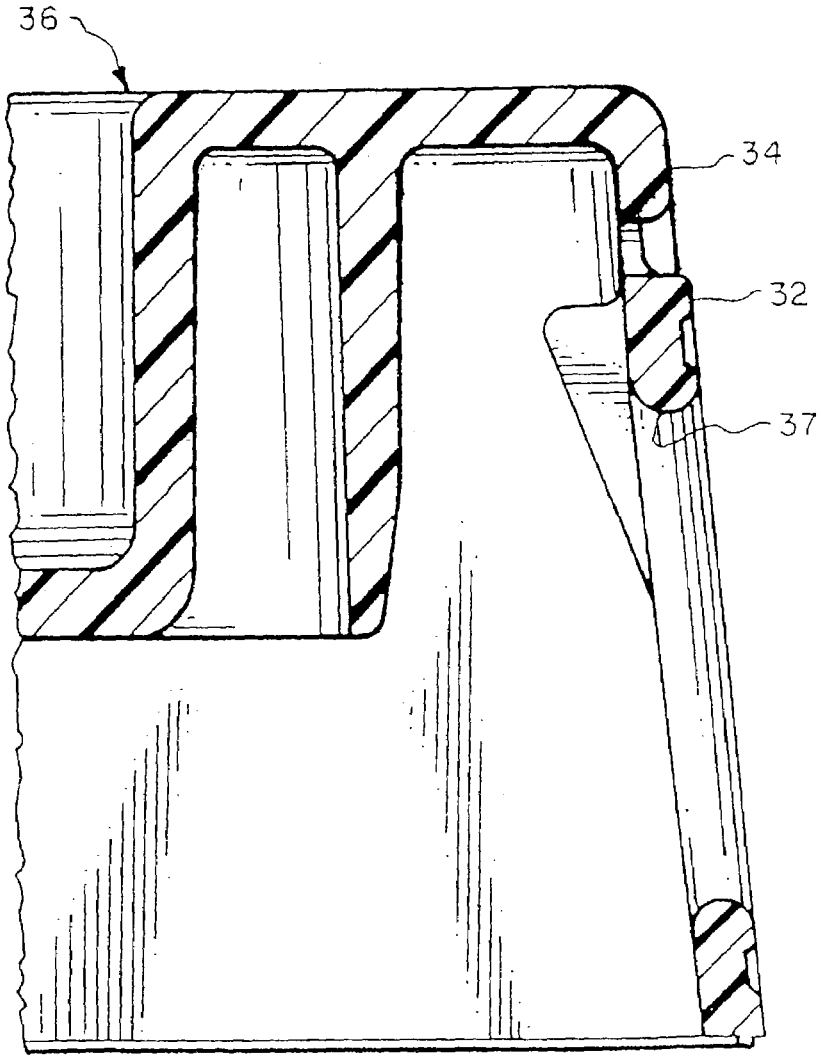
FIG. 5 is a cross-sectional view along reference line 5—5 of FIG. 1.
Figure 12:
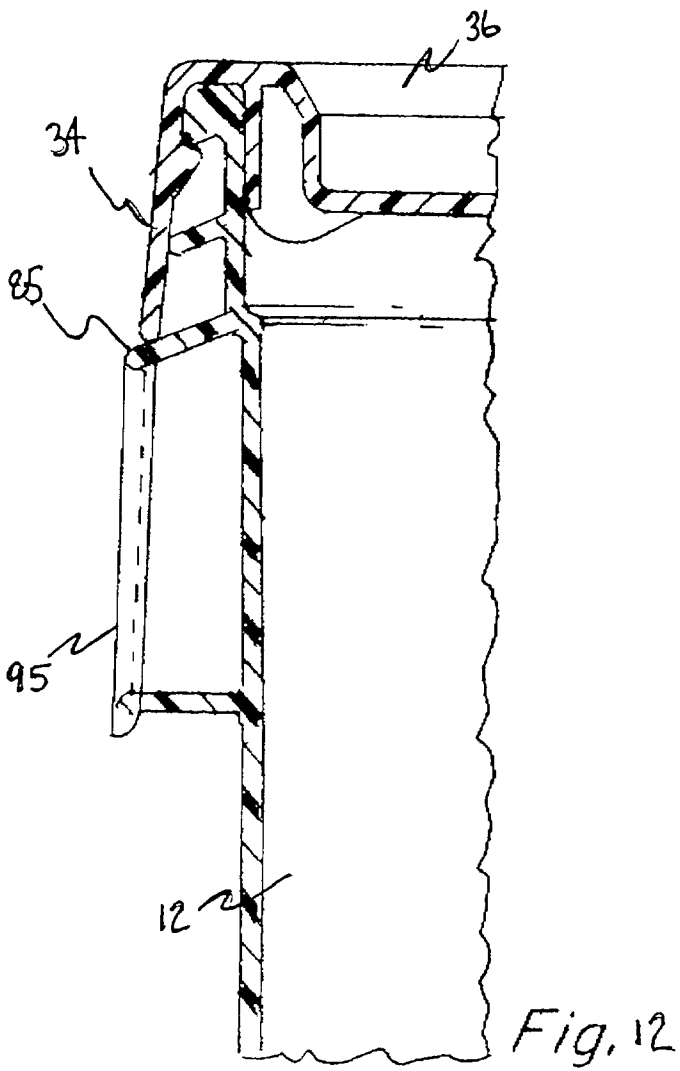
FIG. 12 is sectional view of yet another of the many alternative embodiments of a container lid assembly in accordance with the present invention, is similar to the embodiment of FIG. 11, and shows an alternative arrangement of the satellite ring relative to the bumper.
Figure 11:
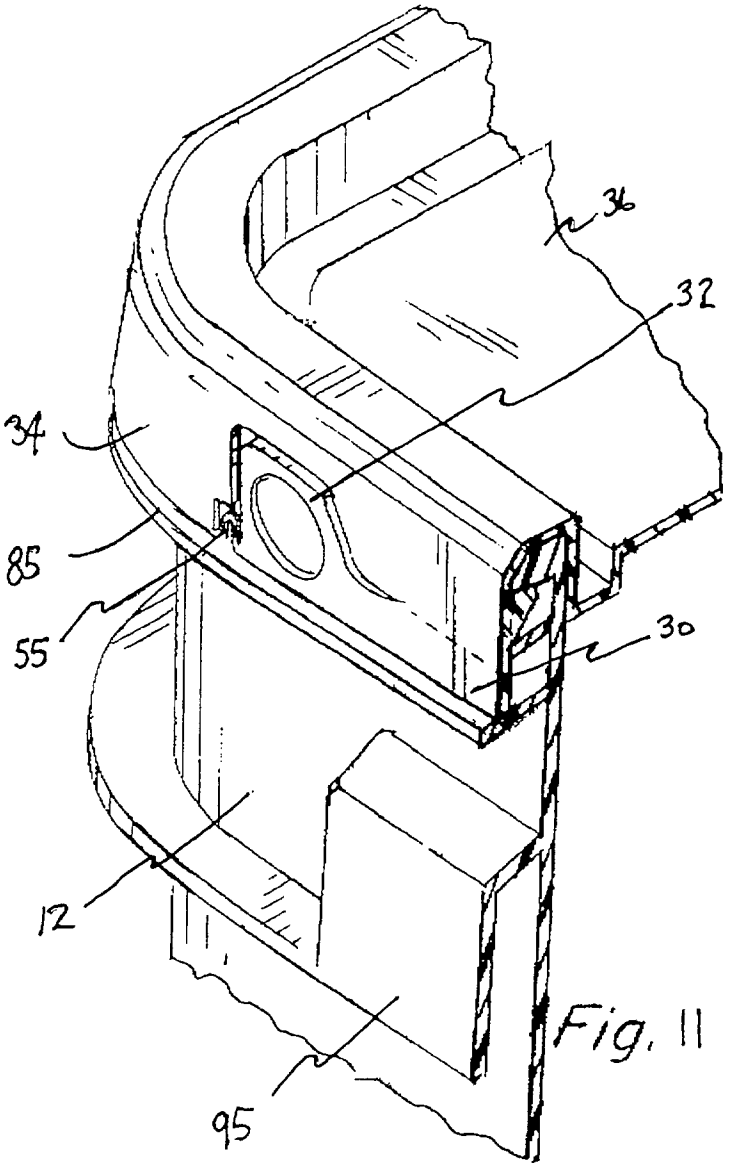
FIG. 11 is a perspective view of another of the many alternative embodiments of a container lid assembly of the present invention, illustrating a pull ring, a connection member, a satellite ring, and a bumper.
Figure 13:
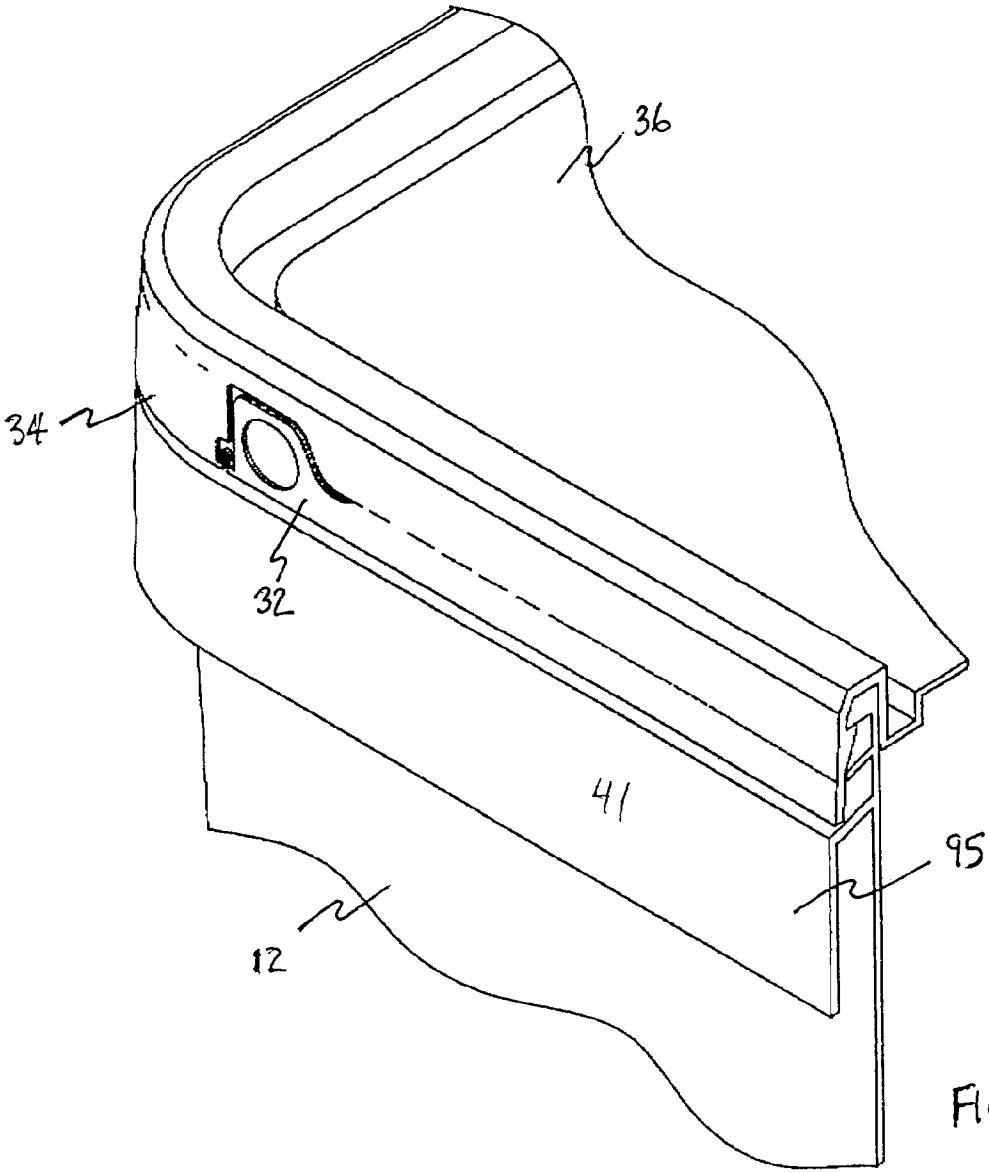
FIG. 13 is a cutaway perspective view of a corner of still another of the many alternative embodiments of the container lid assembly of the invention, illustrating an alternative embodiment of the bumper.

FIGS. 1 and 5 illustrate a preferred embodiment of a container lid in accordance with the present invention, and FIGS. 2–4 and 6–13 illustrate some of the many alternative embodiments. Broadly, instead of a prior art tab such as tab 42 in FIG. 1A or similar structure that requires a user to grip the end of a tearstrip between a finger and thumb (or other digits on the user's hands), one aspect of the invention provides an improved engagement structure for a user's finger. Among other aspects of the invention, a connection structure (see FIGS. 6A–10) can be used in combination with the aforementioned improved engagement structure of the invention (and/or with prior art tabs such as tab 42 of FIG. 1A) to improve the performance and methods of use of such lids and container/lid assemblies. Among other things, the improvements are useful. Furthermore, as shown in FIGS. 11–13, a satellite ring and/or bumper may be used with the improved engagement structure and/or connection member to protect against inadvertent dislodgment of the lid such as during shipment, handling, etc. of the container lid assembly, and protect against and/or provide evidence of tampering to the lid assembly.

The pull ring structure of the invention facilitates easier use for any given tearstrip structure, as compared to conventional tearstrips. Among other things, the improved grippability of the invention permits lids to have thicker (and therefore more rugged and sturdy) tearlines as may be desirable for certain applications, while still permitting a user to remove the tearstrip without undue effort.

Figure 1A:
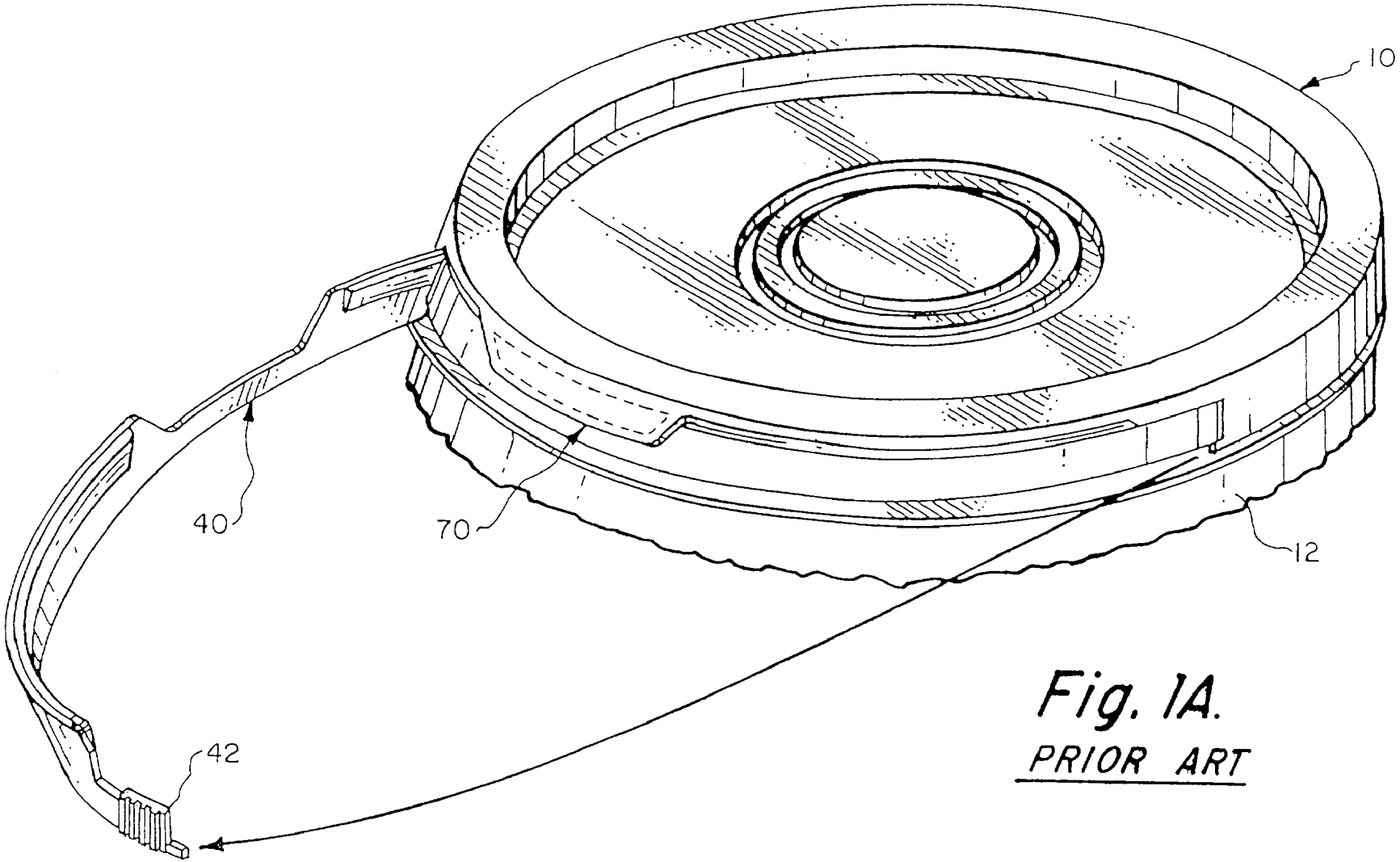
Fig. 1A. PRIOR ART
FIG. 1A is an isometric view of a container lid assembled with a container (of which only the upper container portion is shown), illustrating various general aspects of prior art tearstrips, with the tearstrip shown partially removed (this

Certain basic concepts regarding tearstrips and related matters are disclosed in my U.S. Pat. No. 5,617,968, and the teachings of that patent are expressly incorporated by reference herein. For example, FIG. 1A illustrates a tearstrip 40 partially removed from a container lid 10 (with lid 10 assembled with a container 12). This particular tearline pattern leaves a reclosable tab 70 on the lid 10. A user typically grasps the end 42 of the tearstrip to initiate tearing and removal of the tearstrip 40 from the lid 10.

Although FIG. 1A illustrates a round lid 10 with a sinuous tearline pattern, persons of ordinary skill in the art will understand that the invention is useful on a wide variety of lids and corresponding containers and tearline patterns, including without limitation square, rectangular, hinged, non-hinged, recessed, and others.

In the preferred embodiment of FIG. 1, the end of the tearstrip 30 includes at least one pull ring or pull structure 32 molded at at least one end of the tearstrip 30. Preferably, the pull structure 32 is integrally molded as part of the tearstrip 30. Also preferably, the pull ring or structure 32 is formed in a downwardly-depending skirt 34 integrally molded at the periphery of the lid 36, so that the pull ring 32 is initially positioned within the skirt 34 (prior to removal of the tearstrip from the lid).

Persons of ordinary skill in the art will understand that the preferred tearstrip 30 can function to provide tamper-indicating evidence, including, for example, tearing or other damage to the aforementioned tearline or other parts of the tearstrip. The tearstrip 30 is preferably injection molded as an integral part of the lid 30. Moreover, the preferred lid 10 and tearstrip 30 are fabricated by injection molding or similar process, to provide a suitably strong closure (lightweight or otherwise) for a corresponding container. Persons of ordinary skill in the art will understand that the invention may be effectively practiced with a wide variety of materials and fabrication methods.

In the embodiments of FIGS. 1–5, frangible connector portions 38 are preferably provided to retain the pull ring or structure 32 in general alignment with the lid skirt 34 prior to removing the tearstrip 30. As with other preferred features discussed herein, however, the connector portions 38 are not required for practicing and receiving many of the benefits of the invention. However, and among other things, these connector portions 38 preferably help provide tamper-evidencing and help ensure stackability and nesting (as discussed elsewhere herein) as compared to embodiments without such portions (in which the pull ring 32 might bend toward or away from the center of the lid 36 due to heat shrinkage or the like). Such bending or curling of the pull ring 32 out of its desired general alignment within the lid's flange/skirt 34 can be especially problematic within automated handling/lidding processed and machines, in which a misaligned flange/skirt 34 portion can stop the assembly line or worse. Reinforcing ribs 39 are preferably provided to improve the strength of the pull ring 32. Although the ribs 39 are illustrated as being generally vertical, they can be provided horizontally, angled, cross-hatched, or a wide variety of patterns, including not providing any ribs 32 at all.

The tearstrip 30 is preferably removed from the lid 36 by inserting a finger or other digit in the opening 37, and pulling in the direction indicated by arrow A in FIG. 1. This is the opposite direction from that shown in FIG. 1A, but persons of ordinary skill in the art will understand that either direction can be effectively utilized. For many applications, the tearing direction will not be important.

The opening 37 can be provided in any suitable shape. Among the many alternative embodiments are those shown in FIG. 2 (oval shape 50), FIG. 3 (trapezoidal shape 52), and FIG. 4 (generally C-shaped structure 54). By way of further illustration and not by way of limitation, persons of ordinary skill in the art will understand that the finger gripping section on the tearstrip can be provided similarly to the generally C-shape of FIG. 4, but inverted so that the uncompleted portion of the C-loop faces downwardly (rather than upward and to the right, as shown in FIG. 4). Alternatively, although the pull-ring may be generally C-shaped, the opening associated with the pull-ring may be partially obstructed by material. In this manner, although insertion of a finger may be precluded, a manipulator, as described herein, could still be used to facilitate removal of the tearstrip. In all such embodiments, the tearline aspect of the tearstrip 30 and its removal from the lid 36 can be provided in any suitable manner, such as by a straight or generally horizontal tearline, a sinuous tearline (see FIG. 1A), or otherwise.

By positioning the pull ring or structure 32 generally within the plane of a downwardly depending skirt/flange 34, the lid 36 can be readily stacked and nested, before or after assembly on a container 12, and before or after removal of the tearstrip 30 from the lid 36. For embodiments in which it is desirable to reuse the lid 36 to cover the container opening after the tearstrip 30 has been removed, the entire tearstrip 30 can be located within the skirt 34 about the periphery of the lid 36.

A related preferred method of using the tearstrip 30 of the invention involves providing a lid 36 having the aforementioned characteristics described herein, assembling the lid 36 on a corresponding container 12, engaging at least one finger with the shaped portion of the pull structure 32, pulling with the at least one finger to tear the tearstrip 30 from the lid 36, and removing the lid 36 from the container 12. Prior to the engaging step, the sealed container can be transported, stored, or otherwise handled and processed.

Persons of ordinary skill in the art will understand that the tearstrip 30 can be torn from the lid 36 or otherwise manipulated by things other than human fingers. Although much of the description herein focuses on a user's fingers and other digits on the user's hands, the relevant tearstrip 30 portion can also be considered to be shaped to at least partially wrap around a manipulator (such as a finger, pencil, hook, etc.) to provide selective engagement with the manipulator to assist in tearing of the tearstrip 30 from a lid 36. In other words, instead of engaging the shaped portion with your finger or fingers, you can hook it with a tool or other device. Similarly, for applications in which size or other factors require or make desirable a shape that may not readily engage a user's finger or fingers (see FIG. 4), the invention can be practiced by some other manipulator, as described herein.

Preferably, the manipulator-engaging portion (such as illustrated in FIGS. 2–5) includes a return portion angled by more than 90 degrees with respect to a lengthwise axis of the tearstrip 30. By "bending back" in the direction of the tearstrip 30, the return portion provides an effective hook for engaging a manipulator (again, such as a hook, screwdriver, finger, etc.).

In some instances, assembling the lid 36 onto a container such as container 12 may cause undesirable damage to the lid, and/or can compromise the tamper-evidencing function of the lid. For example, placing the lid on a container may cause frangible connector portions or webbing (even those similar to connector portions 38 of FIGS. 1–5) to "crack" or even break. Among other things, damage of that nature (cracking, breaking, or even possibly stretching or deforming, etc.) may give users/consumers the false impression that the contents of the container 12 have been tampered with. This can be so even if the actual original "seal" between the lid 36 and container 12 remains intact and even if the actual integrity of the sealed container 12 could not be compromised without further "actual" damage to the tear strip 30 or pull ring 32 area.

Figures 9, 10:
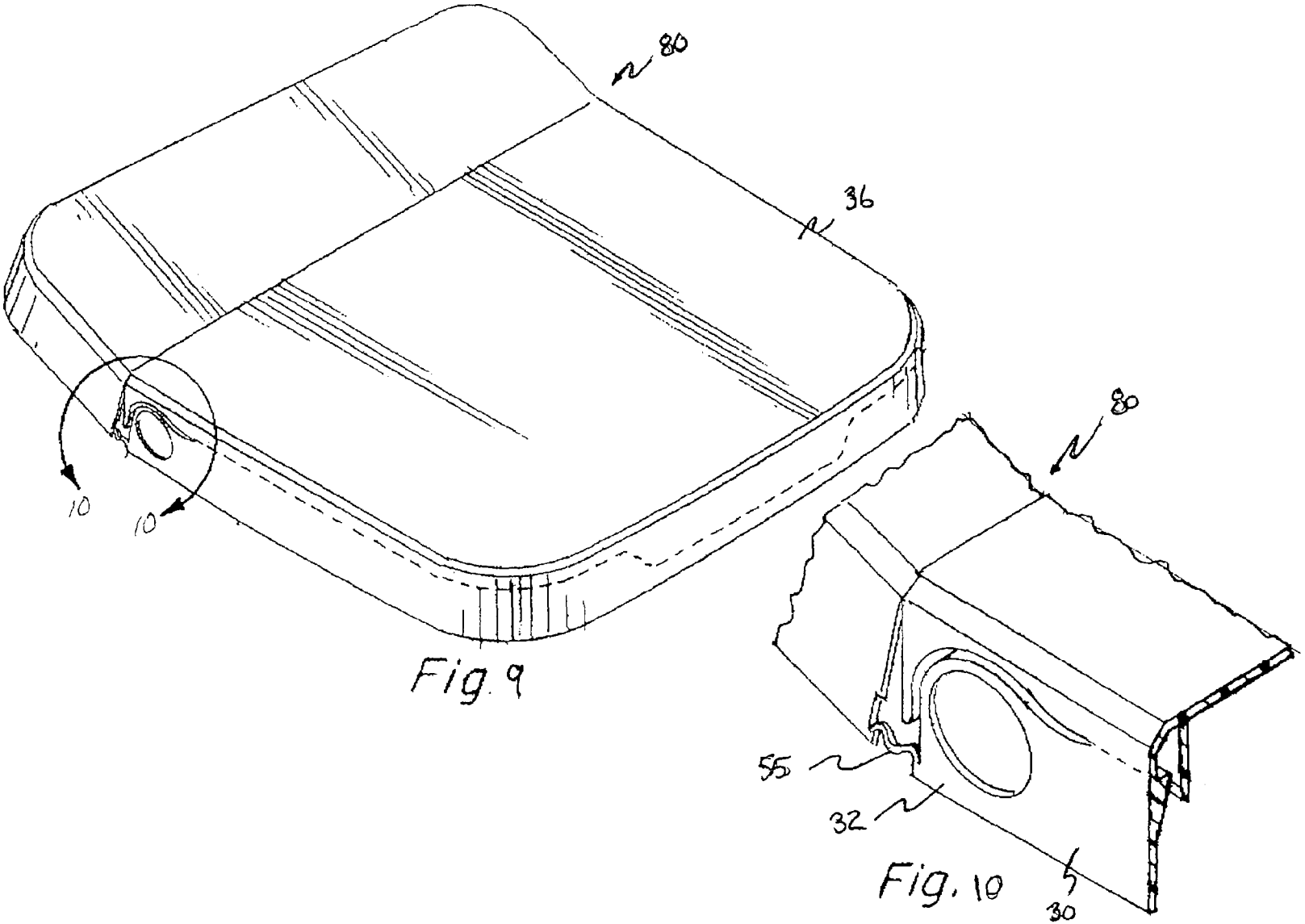
FIG. 9 is a perspective view of one of the many alternative embodiments of a container lid of the present invention, including a pull ring, a connection member, and a hinge structure.
FIG. 10 shows a portion of FIG. 9 taken along line 10—10 and enlarged.

Certain aspects of the invention have utility for applications with lids 36 incorporating living hinges 80, such as shown in FIG. 9. Persons of ordinary skill in the art will understand that such hinges typically are constructed of plastic and integrally molded into the lid 36, and that they typically can (among other things) provide access to the contents of the container 12 while the remainder of lid 36 remains attached to the container 12. It is also known in the art that flexing such hinges (especially while the plastic or similar "living" material is still warm) can help "align" and "set" the molecules within the living hinge 80 in a way that improves the strength and fatigue life and general performance of the hinge 80.

Conventional connection structures or webbing such as elements 38 typically limit the ability to "flex" the living hinge 80 immediately or soon after removal of the lid from its mold. Among other things, flexing the hinge to too great a degree may cause the breakage mentioned above, leading to a false impression that the subsequently assembled lid/container has been tampered with. In theory at least, some people may even get that false impression from inelastic stretching or some damage short of actual breakage.

To best facilitate this tamper-evidencing (at least for potential applications in which a consumer is the ultimate user of the lid/container assembly), the connections must be sufficiently strong to not break when as the lids are being removed from tooling (for injection molded versions) and to not break during automatic or other "lidding" of the lid onto an associated container, but must also be sufficiently "breakable" to permit a user to break open the lid/container assembly. Prior art technology does not balance these goals (strong, yet breakable) very well.

As described herein, however, alternative connection members such as structure 55 (see FIGS. 6A–6D) may be used to provide sufficient or increased degree of "flex" for the hinge, while still maintaining some degree of alignment/planarity of the pull ring 32 within the flange 34. As explained further below and in other of the figures, structure 55 may be provided in any of a wide variety of shapes and sizes and locations. Preferably, elements such as 55 are integrally molded into the lid as part of an injection molding or similar process.

In certain applications (not shown), a plurality of such elements 55 may even be provided on a single lid, spaced from each other. The particular number, relative size, length, and other aspects of any such structure 55 can be selected/designed to address the particular application for which the lid and/or container is intended. Among other things, one or more structures such as element 55 can provide expandability (especially in the hoop direction) in the downward skirt/flange 34 during various processes, such as the molding and/or assembly or handling of the lids/containers.

As mentioned above, and as shown in FIGS. 6A–6D, a connection member 55 may be provided that further balances the desire or need for some degree of "flex" in the downward skirt/flange 34 (useful at various times, such as during the molding and/or assembly or handling processes), while still maintaining a desired or necessary degree of alignment/planarity of the pull ring 32 within the lid's flange 34. In considering FIGS. 6A–6D, as with FIGS. 1–5, person of ordinary skill in the art will understand that the opening 37 can be provided in any suitable shape. Such opening 37 shapes may include, by way of examples and not by way of limitation, oval shape 50, trapezoidal shape 52, and a generally C-shaped structure 54.

As noted above, the precise shape of the connection member 55 can vary widely. Preferably, the connection member shape 55 is shaped (such as with a sufficient curve, bend, twist, or other configuration) to provide the desired blend of stiffness and flexibility as described herein. As illustrated herein, the connection members 55 may include shapes that are substantially half U-shaped (FIG. 6A), U-shaped (FIG. 6B), inverted U-shaped (FIG. 6C), and half inverted U-shaped (FIG. 6D), to name a few. As indicated above, many other connection member 55 shapes are possible so long as the shape of the connection member 55 provides the combination of improved flex (and eventual ability to be torn/broken with sufficient ease when the tearstrip is removed) and sufficient aligning ability and structural integrity.

The precise materials, shapes, and dimensions of the components of the invention can be selected based on the application for which the lid 36 and/or container 12 will be used. For the preferred injection molding process of practicing the invention, the connection member 55 is integrally molded from the same plastic or similar material, and during the same "shot", as the remainder of the lid. Molding or other manufacturing and handling considerations may impact the precise size, shape, and configuration of the connection member 55.

Figure 6A:
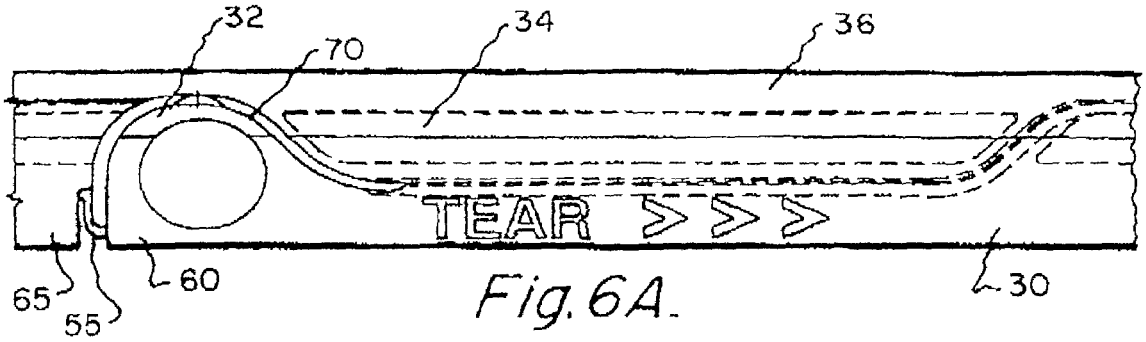
FIG. 6A is a planar view of a tearstrip, showing a preferred connection structure or member between another oval finger or manipulator opening and the associated flange in which it is formed, in accordance with the present invention.
Figure 6B:
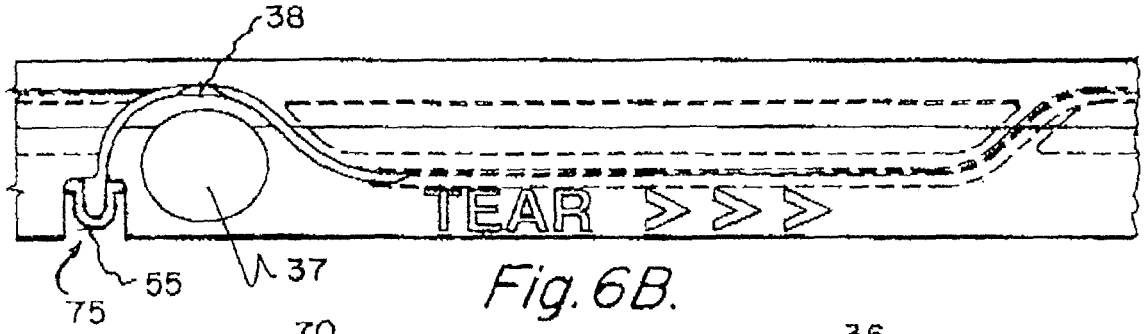
FIG. 6B is similar to FIG. 6A, but shows an alternative embodiment of the connection member in accordance with the present invention.
Figure 6C:
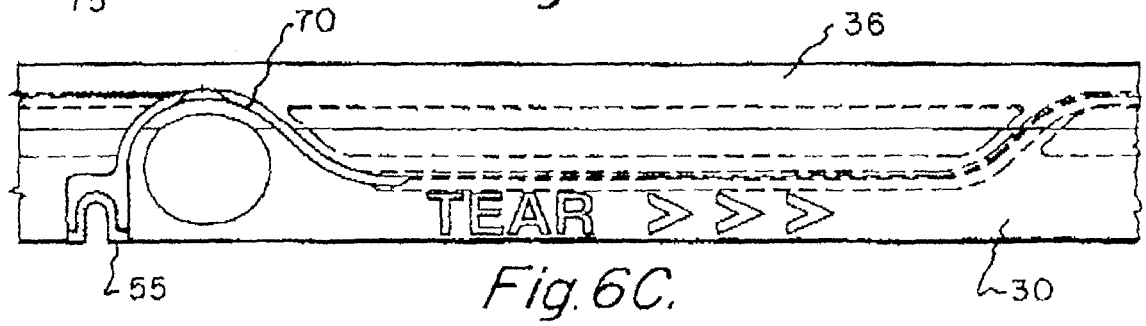
FIG. 6C is similar to FIG. 6A, but shows another embodiment of the connection member in accordance with present invention.
Figure 6D:
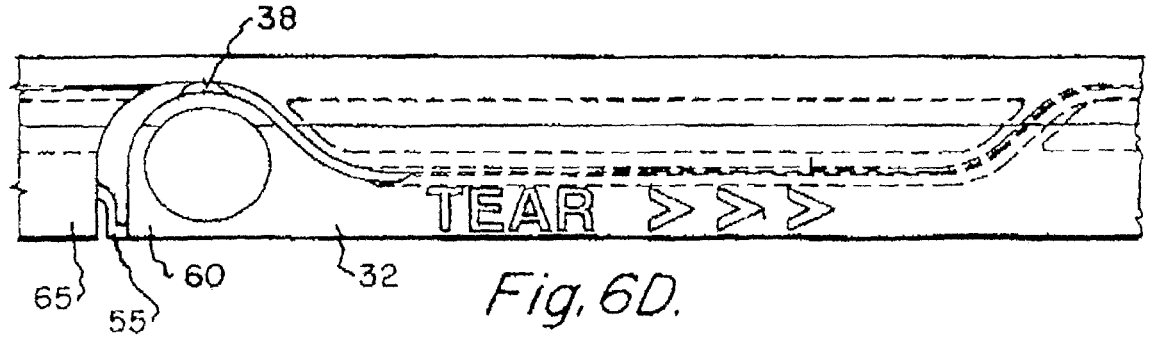
FIG. 6D is similar to FIG. 6A, but shows still another embodiment of the connection member in accordance with the present invention.

FIG. 6A illustrates a planar view of a tearstrip 30 showing one of the many ways in which a connection member 55 can be provided in accordance with the present invention. As indicated above, and as with other tearstrip 30 structures, the connection member 55 is preferably formed by injection molding or a similar process that enables the aforementioned member to be integrally molded as part of the lid 36 assembly. Preferably, the tearstrip 30, pull ring 32, connection member 55, and, if provided, frangible connector(s) 38 are integrally molded substantially along the periphery of the lid 36, and each are within a downwardly-depending skirt 34 (prior to removal of the tearstrip from the lid). The aforementioned aspects of the invention may be practiced with other materials and other methods of manufacture, as described herein. The preferred material for practicing the invention is plastic.

As described above, the pull ring or pull structure 32 preferably is provided in general alignment with the skirt 34, prior to removing the tearstrip 30. Preferably, this is accomplished by one or more frangible connector portions or web/webbing 38 (which also can be provided in a wide variety of shapes, thicknesses, and locations), by connection member 55, and/or by some combination of the two. Where one or more of the connection member 55 is used, it can be located as the "outermost" or "lowermost" of the connection structures (to take advantage of its "flexing" ability, as discussed above, useful for hinged lids and other applications). The connector portion or portions 55 can even maintain the desired alignment of the pull ring or pull structure 32 in situations where "less-flexible" webbing portions 38 might become broken or otherwise disengaged prior to actual removal of the tearstrip from the lid.

Preferably, the frangible connector portion or portions 38 and/or the more flexible connector portion or portions 55 are located generally adjacent and/or between opposite ends of the tearstrip 30, or between one end of the tearstrip and an adjacent portion of the remainder of the lid. In the embodiment of FIGS. 6A–D, the preferred tearstrip 30 may be defined as having a first end 60 and a second end 65. The first end 60 of the tearstrip 30 may be generally defined by the pull ring 32.

Preferably, the frangible connector portion or portions 38 occupy a space or area 70 around or between the first end 60 and the second end 65 of the tearstrip 30. Likewise, the connection member or members 55 are typically located within or around the space or area 70 between opposite ends of the tearstrip 30. As shown in FIGS. 6A–6D, the space 70 needed to accommodate the connection member 55, such as might be defined by a "well" 75, might be greater than the space 70 needed to accommodate the frangible connector portions 38. Persons of ordinary skill in the art will understand that, depending on the application, the opposite might be true, or the spaces might be approximately of equal dimensions.

As described herein, the connection member 55 typically will have at least a somewhat curved shape (more curve will typically provide more degree of flex), and may have a substantially curved shape. Among other things, some amount of curvature or radius along the length of the connection member 55 will improve the desired performance of that connection member 55 (to allow the desired flexing, etc.). However, persons of ordinary skill in the art will understand that, among the many alternative embodiments of the invention, some connection members (not shown) may have straight sections along their length (although these may not perform as well as curved embodiments mentioned above). For example, a "V" or other shape (including two or more straight portions in a single element 55) can be used (alone or in combination with the one or more somewhat curved portions) within or comprising the connection member 55. Among the many alternative embodiments of the invention are shapes 55 such as S, W, N, squared-off U, non-letter (abstract curves and other shapes), and various combinations thereof. For any particular application, the length and complexity of the shape of connection member 55 has to be balanced against the desired or necessary "stiffness" or alignment of the gripping portion within the downward lid flange). Longer and more complicated shapes may provide greater flex, but may reduce the alignment function of the member 55.

Another way to describe this aspect of the invention is that connection member 55 is not a single straight section, but preferably is "longer" (by virtue of its bent or winding path or shape) than the "straight line" distance it spans across the space or well in which the member 55 is positioned.

Persons of ordinary skill in the art will understand that, in many embodiments (such as those shown in the drawings) in which the space or area 70 extends generally around the pull ring 32 and continues at least somewhat in the direction of the elongated body portion of tearstrip 30, the position of the connection member 55 is not limited to that shown in FIGS. 6A–6D, but may be positioned at other locations along the space 70. Likewise, positioning of the living hinge 80 is not restricted to the location shown in FIGS. 9 and 10, but may be positioned anywhere along the space or opening 70 or otherwise, such that the hinge 80 and connection member 55 are still able to "flex" during the molding and/or assembly process. Moreover, as indicated above, multiple connection members 55 may be provided along the space or opening 70. If located in a position other than that shown in FIGS. 6A–6D, the width of the space or area 70 between the pull ring 32 may have to be increased to accommodate the connection member 55, depending on its specific configuration, size, thickness, and other design considerations. In other words, formation of additional or differently located "wells" 75 or similar structures may be needed.

The preferred connection member 55 is a relatively less "taut" connection between the tearstrip gripping portion and the opposite end of the tearstrip, as compared to prior art of which the inventor is aware. Whether this lessened "tautness" is provided by the preferred curved shape shown in the drawings or otherwise, it preferably allows connection member 55 to remain intact (and functioning, among other things, to urge the pull ring or other tearstrip gripping structure back into desired planar alignment within the lid's flange) through a greater degree of flexion or deformation than do prior art devices.

Among other things, such greater "flexibility" is useful for embodiments in which the lid incorporates a "living hinge." As indicated above, it is known that such flexing while the hinge material is still warm can "align" and "set" the molecules within and/or adjacent the plastic living hinge 80 (see, for example, FIGS. 9 and 10) in a way that improves the strength and fatigue life of the living hinge. FIGS. 9 and 10 show the connector portion 55 in an "extended" but unbroken position, such as while a living hinge 80 is being flexed just after manufacture. Thus, the connection member 55 of the present invention is highly desirable in the manufacturing, assembly, handling, and other uses of the lid and related container/lid assemblies.

In all such embodiments utilizing the connection member 55, the tearline aspect of the tearstrip 30 and its removal from the lid 36 preferably can be provided in any suitable manner, such as by a straight or generally horizontal tearline, a sinuous tearline (shown in FIGS. 1–5), or otherwise.

Figure 7:
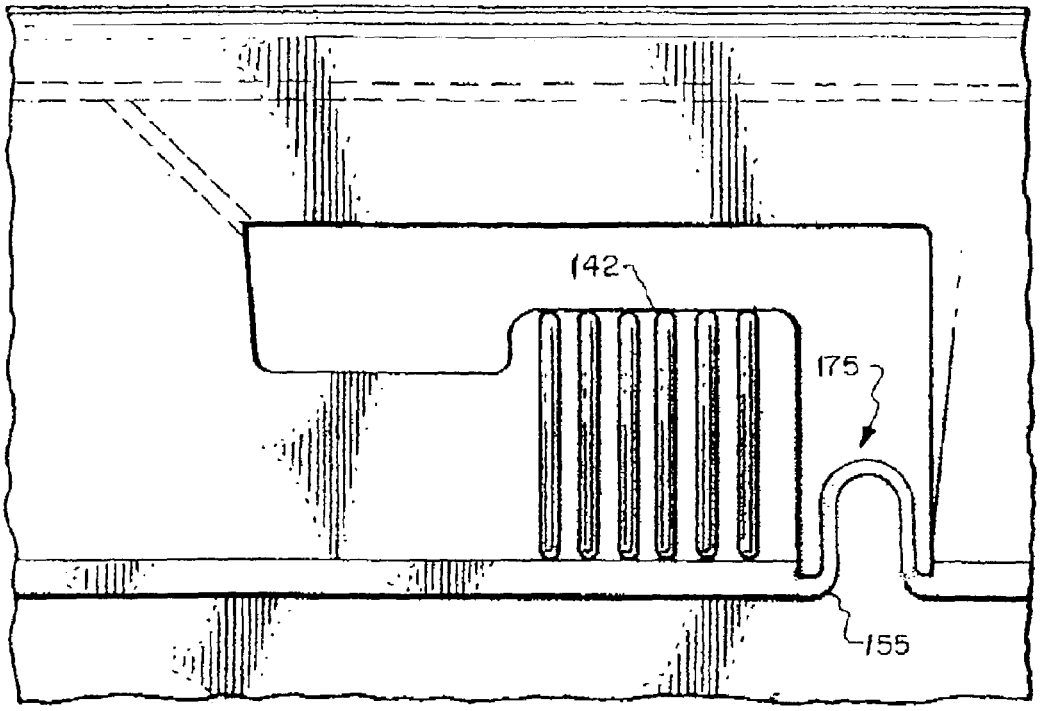
FIG. 7 shows a tearstrip similar to that of FIG. 1A, with a connection member in accordance with the present invention.
Figure 8:
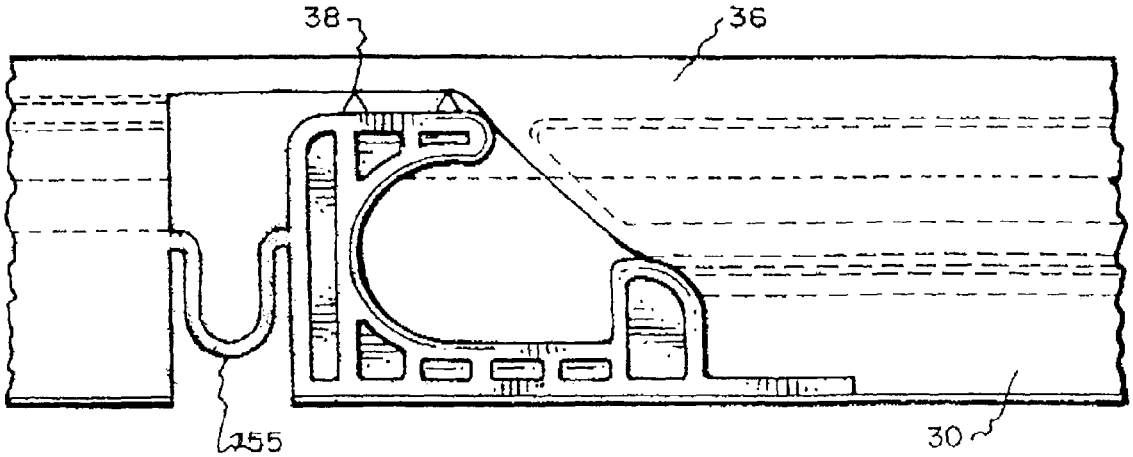
FIG. 8 shows a tearstrip similar to that of FIG. 4, with a connection member in accordance with the present invention.

FIGS. 6A–6D show the connection member 55 joining one end of the tearstrip 30 with a pull ring 32 having a substantially oval shape, but other pull ring structures and shapes, such as those shown in FIGS. 1–4 (and others, not shown) may used with the connection member 55 in order to realize its benefits. For example, and as shown in FIG. 7, the straight extension on the tab 142 (similar to that of the lid assembly shown in FIG. 1A) may be replaced with a connection member 155 having a substantially curved shape located in an "well" or open area 175, similar to the "well" 75 shown in FIG. 6B. In addition, and as shown in FIG. 8, a tearstrip similar to FIG. 4 may be modified to include a connection member 255. Likewise (but not illustrated in the drawings), each of the tearstrips depicted in FIGS. 1–3 may include a connection member such as member 55, thus providing the lid assembly with some increased degree of "flex" and alignment functionality, as described herein while also providing sufficiently ready breakability (especially for consumer end users, as mentioned above).

Among other things, the preferred extendible connection member 55 can provide additional flex to a hinge portion of the lid, without destroying the subsequent tamper-evidencing value of the lid. In other words, the hinged portion of a lid may be flexed prior to assembly of the lid onto a container without breaking the extendible connection member 55. Instead, connector 55 simply extends during the flex and returns to its original shape when the lid/hinge is again flat. Preferably, the connection member 55 then helps hold the tearstrip end or ends within the desired generally planar alignment of the outermost downward flange on the lid (to permit stacking, prevent breaking, etc.). Eventually, the lid can be assembled onto a container and the tamper-evidencing features of the lid (including the unbroken connection member 55) will remain effective for the desired tamper-evidencing function.

Other examples of the many alternative embodiments of the invention include multiple pull rings (not shown) and/or multiple connection structures (also not shown) between a given pull ring and the associated lid flange, provided on a single or multiple tearstrips 30. Similar to the use of a single or first pull ring 32, any such second or additional pull ring will typically be integrally molded substantially along the periphery of the lid 36, and will also be disposed in a generally coplanar relationship with a downwardly-depending skirt 34. Positioning of the pull rings may be such that a selected segment/portion of the tearstrip 30 or the entire tearstrip 30 may be removed. Preferably, at least one of the plurality of pull rings will have a connection member 55, as described herein. In addition, the size, shape, and material construction of each of the multiple pull rings and/or connection members 55 may differ from the other pull rings and/or connection members on the same tearstrip 30.

In any case, the connection member preferably is fabricated with sufficient material memory to permit member to expand (or extend) to allow hinging or assembly of the lid onto a container and to thereafter urge the lid sections to which the connection member is attached (such as the first and second ends of the tearstrip) back toward each other.

FIG. 11 is a perspective view of one of the many embodiments of a container lid assembly of the present invention, and shows a pull ring, a connection member, a satellite ring, and a bumper. Although aspects of the invention can be practiced without any such satellite ring or bumper, the satellite ring and/or bumper can (among other things) improve the tamper-evidencing function of the invention. The satellite ring 85 may be positioned on the container 12 near the opening of the lid and preferably extends outwardly from the container sidewall to underlie the downward edge of the skirt/flange 34 and/or tearstrip 36. By extending outwardly at least to that downward flange edge, the satellite ring or similar structure can help make it more difficult for persons to remove the lid from the container without leaving some "tamper-indication" such as a tear along the tearstrip or other damage or deformation to the assembly.

Typically, the satellite ring 85 will extend outward from the container 12 or lid 36 and peripherally about the entire container 12 or lid 36, or some portion thereof. As best shown in FIG. 12, the satellite ring 85 may extend beyond the flange 34 and/or tearstrip 32. In this arrangement, the satellite ring 85 protects against inadvertent dislodgment of the lid 36 such as during shipment, handling, etc. of the container lid assembly, and protects against and/or provides evidence of tampering to the lid assembly so that any tampering is substantially likely to be evidenced by deformation or other damage to the peripheral structure 85, flange 34, tearstrip 30, and/or some combination thereof. Alternatively, so long as the satellite ring 85 provides the benefits as described herein, the satellite ring 85 may be extended outwardly more or less than that shown in FIG. 12.

The inadvertent dislodgment and/or protection against and/or providing evidence of tampering to the lid assembly is at least partially due to the close proximity or substantially flush positioning of the satellite ring 85 relative to the flange 34 and/or tearstrip 30. Positioning of the satellite ring 85 in such a manner will typically preclude finger(s) or other objects access under the flange 34 and/or tearstrip 30 where they may lift, pry, or dislodge the lid 36 from the container 12.

In the preferred embodiment of the invention, lids 36 stacked upon each other are not spaced from each other by any extension of the pull ring 32 outside of the general plane and dimensions of the lid's downward flange 34. The pull ring 32 and related structures are thus further protected from damage during shipment, handling, etc. of the container lid assembly, and the space efficiency of stacked lids is increased.

In addition to the satellite ring 85, a bumper 95 may be provided either alone or in combination with the satellite ring 85, the improved engagement structure 32, and/or the connection member 55. These various elements and/or combinations thereof can protect against inadvertent dislodgment of the lid such as during shipment, handling, etc. of the container lid assembly, and protect against and/or provide evidence of tampering to the lid assembly. Similar to the satellite ring 85, the bumper 95 may be attached to (and is preferably integrally formed on) the container 12 and will typically extend outward from the container 12 and peripherally about all or some portion of the container 12. Depending on its positioning, the bumper 9 may provide various benefits. For example, when positioned near the flange 34 or tearstrip 30 the bumper 95 may reinforce the satellite ring 85 from below (as shown in FIG. 12), "replace" the satellite ring 85 (as shown in FIG. 13), and/or otherwise provide stability to the sidewall of the container 12 and protection to the lid assembly during side-by-side stacking of containers (as shown in FIGS. 11–13). Furthermore, the preferred downward flange 41 of the bumper 95 and/or the satellite ring 85 may facilitate lifting of the container 12 by providing a convienent area for hand placement, such as can be appreciated in FIGS. 11–13.

In contrast to the present invention, certain prior art pull rings on tearstrips (including, for example, U.S. Pat. No. 4,718,571, issued 12 Jan. 1988 to Bordner and Switzerland Patent No. 672,473, issued November 1989) extend outwardly and downwardly in a way that precludes tamper-evidencing such as can be provided by the present invention. Among other things, such prior art technology does not permit close abutment of an underlying satellite ring or bumper, and therefore has an increased susceptibility to someone defeating the tamper-evidencing by prying off the lid (such as by inserting a screwdriver under the tearstrip and prying without breaking any portion of the lid), tampering with the contents, and replacing the lid.

Among the many embodiments of the invention, those having bumpers or satellite rings such as described herein may include bumpers or satellite rings having staggered heights and/or vertical locations (see FIG. 11). In other words, rather than having a consistent cross section at a fixed height around the container, portions of the bumpers or satellite rings may be positioned lower or higher (see the "lower" corner portions of bumper 95 in FIG. 11), may have differing cross-sections at different locations around the container (FIG. 11 shows a horizontal portion at the corner but a downward L-shape adjacent thereto), may be interrupted, etc.

Although the preferred embodiment of the invention has been described with some specificity, the description and drawings set forth herein are not intended to be delimiting, and persons of ordinary skill in the art will understand that various modifications may be made to the embodiments discussed herein without departing from the scope of the invention, and all such changes and modifications are intended to be encompassed within the appended claims.

What is claimed is:

1. A tearstrip assembly in combination with lid, including a pull ring molded at one end of said tearstrip, said lid having a downwardly-depending skirt integrally molded at its periphery, said skirt having a lower edge at generally a constant level around said periphery, said pull ring initially positioned a coplanar orientation with said skirt and not extending substantially below said lower edge of said skirt.

2. A container lid having a tearstrip, said tearstrip being injection molded as an integral part of said lid prior to removal of said tearstrip from the remainder of said lid, said tearstrip including a pull structure located in the same planar orientation as said tearstrip, said pull structure affixed to one end and positioned in an outer flange of said lid, said pull structure having a portion shaped to receive at least one finger of a user's hand to assist the user to initiate tearing of said tearstrip from said lid, said removal of said tearstrip permitting opening of said lid from its associated container, said shaped portion configured to eliminate the need to grip said tearstrip between opposing digits on the user's hand in order to initiate said tearing.

3. A container lid having a tearstrip, said tearstrip being injection molded as an integral part of said lid prior to removal of said tearstrip from the remainder of said lid, said tearstrip having a lower edge generally at the same height around the periphery of said lid and presenting a generally smooth lower edge without substantial protrusions therefrom, a pull structure located a coplanar orientation with said tearstrip and substantially positioned above said lower edge, said pull structure affixed to one end and positioned in an outer flange of said lid, said pull structure having a manipulator-engaging portion to assist in tearing of said tearstrip from said lid, said removal of said tearstrip permitting opening of said lid from its associated container, said manipulator-engaging portion including a return portion angled by more than 90 degrees with respect to a lengthwise axis of said tearstrip so that said return portion provides an effective hook for engaging a manipulator.

4. The lid of claim 2 or claim 3, in which said shaped or manipulator-engaging portion of said pull structure is generally C-shaped.

5. A container lid having a tearstrip, said tearstrip being injection molded as an integral part of said lid prior to removal of said tearstrip from the remainder of said lid, said tearstrip including a pull structure affixed to one end and positioned in a coplanar orientation with an outer flange of said lid, said pull structure having a manipulator-engaging portion to assist in tearing of said tearstrip from said lid, said removal of said tearstrip permitting opening of said lid from its associated container, said manipulator-engaging portion including a return portion angled by more than 90 degrees with respect to a lengthwise axis of said tearstrip so that said return portion provides an effective hook for engaging a manipulator, in which said manipulator-engaging portion of said pull structure is generally C-shaped, in which said generally C-shaped pull structure portion constitutes an uncompleted loop, in which said uncompleted portion of said loop is directed generally downwardly.

6. The lid of claim 2 or claim 3, including frangible connections between said pull structure and adjacent portions of said lid, said frangible connections providing tamper-evidencing and helping to hold said pull structure in general alignment with said adjacent portions of said lid prior to tearing said tearstrip.

7. The lid of claim 2 or claim 3, in which said tearstrip is positioned within said lid such that removal of said entire tearstrip leaves a remaining portion of said lid that is capable of covering the corresponding opening in the associated container.

8. A method of closing and opening a container, including the steps of:

providing a container lid having a tearstrip, said tearstrip being injection molded as part of said lid prior to removal of said tearstrip from the remainder of said lid, said tearstrip having a generally lowermost edge that is located at generally the same vertical position about the periphery of said lid, said edge being generally smooth without substantial downward or outward protrusions therefrom, a pull structure affixed to one end of said tearstrip and positioned in a coplanar orientation with an outer flange of said lid and not extending substantially below said lower edge of said tearstrip, said pull structure having a portion shaped to receive at least one finger of a user's hand to assist the user to initiate tearing of said tearstrip from said lid, said removal of said tearstrip permitting opening of said lid from its associated container, said shaped portion configured to eliminate the need to grip said tearstrip between opposing digits on the user's hand;

assembling said lid on said container;

engaging at least one finger with said shaped portion of said pull structure;

pulling with said at least one finger to tear said tearstrip from said lid; and removing said lid from said container.

9. The lid of claim 2 or claim 3, in which said shaped or manipulator-engaging portion of said pull structure is not oval.

10. A method of closing and opening a container, including the steps of:

providing a container lid having a tearstrip, said tearstrip being injection molded as part of said lid prior to removal of said tearstrip from the remainder of said lid, said tearstrip including a pull structure affixed to one end and positioned in an outer flange of said lid, said pull structure located generally the same planar orientation as said tearstrip and not extending substantially outwardly or downwardly from said outer flange, said pull structure having a portion shaped to at least partially wrap around a manipulator and provide selective engagement with said manipulator to assist in tearing of said tearstrip from said lid, said removal of said tearstrip permitting opening of said lid from its associated container;

assembling said lid on said container;

engaging at manipulator with said shaped portion of said pull structure;

pulling with said manipulator to tear said tearstrip from said lid; and removing said lid from said container.

11. The method of claim 10, in which said manipulator-engaging portion includes a return portion angled by more than 90 degrees with respect to a lengthwise axis of said tearstrip so that said return portion provides an effective hook for engaging a manipulator.

12. A lid assembly comprising:

a tearstrip having a first end and a second end; and an extendible connection member having a first end and a second end, said first end of said extendible connection member operatively affixed to said first end of said tearstrip;

wherein said tearstrip and said connection member are each integrally molded generally in the same planar orientation substantially along the periphery of the lid, said tearstrip forms part of a downwardly-depending skirt at that periphery.

13. The lid assembly of claim 12, in which said connection member is positioned within the general plane of that downwardly-depending skirt.

14. The lid assembly of claim 12, further including a first pull ring connected to said first end of said tearstrip.

15. The lid assembly of claim 12, wherein said connection member is positioned in a open well formed in said skirt.

16. The lid assembly of claim 12, in which said connection member is frangible and is attached between the first end and the second end of said tearstrip.

17. The lid of claim 12, wherein the lid is fabricated by injection molding.

18. The lid assembly of claim 14, further including a second pull ring integrally molded substantially along the periphery of the lid, and positioned within said downwardly-depending skirt.

19. A lid assembly comprising: a tearstrip having a first end and a second end; and an extendible connection member having a first end and a second end, said first end of said extendible connection member operatively affixed to said first end of said tearstrip;

wherein said tearstrip and said connection member are each integrally molded generally in the same planar orientation substantially along the periphery of the lid, said tearstrip forms part of a downwardly-depending skirt at that periphery, wherein the connection member is substantially half U-shaped.

20. A lid assembly comprising: a tearstrip having a first end and a second end; and an extendible connection member having a first end and a second end, said first end of said extendible connection member operatively affixed to said first end of said tearstrip;

wherein said tearstrip and said connection member are each integrally molded generally in the same planar orientation substantially along the periphery of the lid, said tearstrip forms part of a downwardly-depending skirt at that periphery; wherein the connection member is substantially U-shaped.

21. A lid assembly comprising: a tearstrip having a first end and a second end; and an extendible connection member having a first end and a second end, said first end of said extendible connection member operatively affixed to said first end of said tearstrip;

wherein said tearstrip and said connection member are each integrally molded generally in the same planar orientation substantially along the periphery of the lid, said tearstrip forms part of a downwardly-depending skirt at that periphery, wherein the connection member is substantially inverted U-shaped.

22. A lid assembly comprising: a tearstrip having a first end and a second end; and an extendible connection member having a first end and a second end, said first end of said extendible connection member operatively affixed to said first end of said tearstrip;

wherein said tearstrip and said connection member are each integrally molded generally in the same planar orientation substantially along the periphery of the lid, said tearstrip forms part of a downwardly-depending skirt at that periphery, wherein the connection member is substantially half inverted U-shaped.

23. A lid assembly comprising:

a tamper evidence tearstrip having a first end and a second end, said tearstrip being injection molded as an integral part of the lid prior to removal of said tearstrip from the remainder of the lid; and a pull ring affixed to said first end of said tearstrip, said pull ring having a portion shaped to receive at least one finger of a user's hand;

wherein said pull ring is integrally molded substantially along the periphery of the lid within a plane defined by a downwardly-depending skirt and not extending below the bottom of said skirt.

24. The lid assembly of claim 23, further including an extendible connection member connecting at least one end of said tearstrip to an adjacent location on said lid, said connection member having sufficient flexibility and material memory to permit said first and second ends to move away from each other and to thereafter urge said first and second ends back toward each other.

25. The lid assembly of claim 24, in which said adjacent location on said lid is a second end of said tearstrip.

26. A method of closing and opening a container, including the steps of:

(a) providing the lid assembly of claim 14;

(b) assembling said lid assembly on a container;

(c) engaging at least one finger with said shaped portion of said pull ring;

(d) pulling with said at least one finger to tear said tearstrip from said lid assembly; and (e) disengaging at least part of said lid assembly from said container.

27. The method of claim 26, wherein the position of said substantially curved connection member is between said first end and said second end of said tearstrip.

28. The method of claim 26, further including a second pull ring integrally molded substantially along the periphery of the lid, and positioned within said downwardly-depending skirt.

29. The method of claim 28, further comprising the step of repeating steps (c) and (d) for said second pull ring.

30. A lid in combination with a container comprising:

a tamper evidence tearstrip having a first end and a second end, said tearstrip being injection molded as an integral part of the lid prior to removal of said tearstrip from the remainder of the lid;

at least one pull ring affixed to at least one of said first end and said second end of said tearstrip, said pull ring having a portion shaped to receive a manipulator, said pull ring being positioned within a downwardly-depending skirt and does not interfere with nesting of like-shaped and sized lids; and a satellite ring extending outward from the container to substantially abut and underlie a downwardly-depending skirt of the lid, said ring extending generally peripherally about the container, said satellite ring helping to provide evidence of tampering after said lid is assembled on said container.

31. The lid and container combination of claim 30, further including a substantially curved connection member connecting said first end of said tearstrip to adjacent structure on said lid.

32. The lid and container combination of claim 30, wherein said satellite ring extends outward beyond said downwardly-depending skirt to protect the lid from inadvertent dislodgement during handling.

33. The lid and container combination of claim 32, in which said pull ring is configured such that like lids nested with each other are not spaced from each other by contact with the pull ring.

34. The lid and container combination of claim 32, further including a bumper extending outward from the container, and extending peripherally about the container.

35. A lid assembly comprising:

a tearstrip having a first end and a second end; and a connection member positioned and operatively affixed between the first end and the second end of the tearstrip, and having a length longer than the shortest planar distance that the connection member spans between the tearstrip ends;

wherein said tearstrip and said connection member are each integrally molded generally in the same planar orientation substantially along the periphery of the lid, said tearstrip forms part of a downwardly-depending skirt at that periphery.

36. A lid assembly comprising:

a tearstrip having a first end and a second end; and a non-linear connection member positioned and operatively affixed between the first end and the second end of the tearstrip;

wherein said tearstrip and said connection member are each integrally molded generally in the same planar orientation substantially along the periphery of the lid, said tearstrip forms part of a downwardly-depending skirt at that periphery.

37. A lid assembly comprising:

a tearstrip having a first end and a second end; and an expandable connection member positioned and operatively affixed between the first end and the second end of the tearstrip;

wherein said tearstrip and said connection member are each integrally molded generally in the same planar orientation substantially along the periphery of the lid, said tearstrip forms part of a downwardly-depending skirt at that periphery.

* * * * *

UNITED STATES PATENT AND TRADEMARK OFFICE

CERTIFICATE OF CORRECTION

PATENT NO. : 7,134,567 B2
APPLICATION NO. : 10/404899
DATED : November 14, 2006
INVENTOR(S) : Frano Luburic It is certified that error appears in the above-identified patent and that said Letters Patent is hereby corrected as shown below:

Column 12, Line 1, “positioned a” should read --positioned in a--

Column 12, Line 22, “located a” should read --located in a--

Column 13, Line 33, “generally the” should read --generally in the--

Signed and Sealed this

Twenty-ninth Day of May, 2007

JON W. DUDAS
*Director of the United States Patent and Trademark Office*